US006183287B1

(12) United States Patent
Po

(10) Patent No.: US 6,183,287 B1
(45) Date of Patent: Feb. 6, 2001

(54) ELECTRICAL CONNECTOR

(75) Inventor: Peter Po, Tu-Chen (TW)

(73) Assignee: Hon Hai Precision Ind. Co., Ltd., Taipei Hsien (TW)

( * ) Notice: Under 35 U.S.C. 154(b), the term of this patent shall be extended for 0 days.

(21) Appl. No.: 09/422,823

(22) Filed: Oct. 21, 1999

(30) Foreign Application Priority Data

Dec. 31, 1998 (TW) ..... 87222134
Dec. 31, 1998 (TW) ..... 87222135

(51) Int. Cl.[7] ..... H01R 13/627
(52) U.S. Cl. ..... 439/358; 439/378
(58) Field of Search ..... 439/378, 379, 439/358, 357, 680, 681

(56) References Cited

U.S. PATENT DOCUMENTS 5,131,867 * 2/1998 Peloza et al. ..... 439/557
5,342,221 * 8/1994 Peterson ..... 439/677
5,716,227 * 2/1998 Detter ..... 439/358
5,775,932 * 7/1998 Saito et al. ..... 439/378
6,024,594 * 2/1998 Self, Jr. et al. ..... 439/358

* cited by examiner

*Primary Examiner*—Gary F. Paumen
(74) *Attorney, Agent, or Firm*—Wei Te Chung

(57) ABSTRACT

An electrical connector assembly includes a male connector and a female connector. The male connector comprises an insulative housing, a plurality of silos projecting from the housing, a plurality of contacts received in the silos, a guiding arm formed on a top surface of the housing and a pair of fixing bars extending from distal ends of the housing. The female connector has an insulative housing, a plurality of receptacles formed in the housing for engaging with the corresponding silos, an engaging slot formed in a top surface of the housing, and a plurality of terminals received in the receptacles for electrically contacting the corresponding terminals of the male connector. In assembly, the guiding arm of the male connector is inserted into the engaging slot of the female connector for guiding the connectors and preventing improper engagement therebetween. The silos and the receptacles are manufactured with the same rectangular cross-section thereby reducing production costs.

1 Claim, 6 Drawing Sheets

ELECTRICAL CONNECTOR

BACKGROUND OF THE INVENTION

The present invention relates to an electrical connector assembly, and particularly to an electrical connector assembly having a guiding structure for ensuring proper orientation when mating two connectors of the assembly.

U.S. Pat. Nos. 5,342,221, 5,131,867, German Patent No. DE 4025571A1 and Taiwan Patent Application Nos. 80208826; 82200584; 83105748; 83301429; and 83110257 disclose related electrical connectors. A conventional electrical connector assembly as illustrated in FIG. 1 comprises a male connector 5 and a female connector 6 to be assembled together. The male and female connectors 5, 6 include dielectric housings 50, 60, a plurality of silos 52, and corresponding receptacles 62. Each silo 52 receives a terminal (not shown) therein for electrically engaging a contact (not shown) received in the corresponding receptacle 62. For preventing improper engagement orientation, each silo 52 has a flattened corner for engaging with the corresponding receptacle 62 (FIGS. 2A and 2B). The conventional design prevents improper engagement, however, a mold for forming the conventional connector is difficult to manufacture and assemble thereby increasing production costs. Thus, a connector for preventing improper engagement and having a simplified structure is requisite.

BRIEF SUMMARY OF THE INVENTION

A main object of the present invention is to provide an electrical connector assembly having male and female connectors with a guiding structure for preventing improper mating orientation therebetween.

Another object of the present invention is to provide an electrical connector assembly manufactured from a simple mold thereby reducing production costs.

To fulfill the above-mentioned objects, according to a preferred embodiment of present invention, an electrical connector assembly includes a male connector and a female connector. The male connector comprises an insulative body, a plurality of silos projecting from the body, a plurality of contacts received in the silos, a guiding arm formed on a top surface of the body and a pair of fixing bars extending from distal ends of the body. The female connector has an insulative housing, a plurality of receptacles formed in the housing for engaging with the corresponding silos, an engaging slot formed in a top surface of the housing, and a plurality of terminals received in the receptacles for electrically contacting the corresponding contacts of the male connector. In assembly, the guiding arm of the male connector is inserted into the engaging slot of the female connector for guiding the connectors and preventing improper engagement therebetween. The silos and the receptacles are manufactured with the same rectangular cross-section thereby reducing producing production costs.

Other objects, advantages and novel features of the invention will become more apparent from the following detailed description when taken in conjunction with the accompanying drawings.

DETAILED DESCRIPTION OF THE INVENTION

Figure 1:
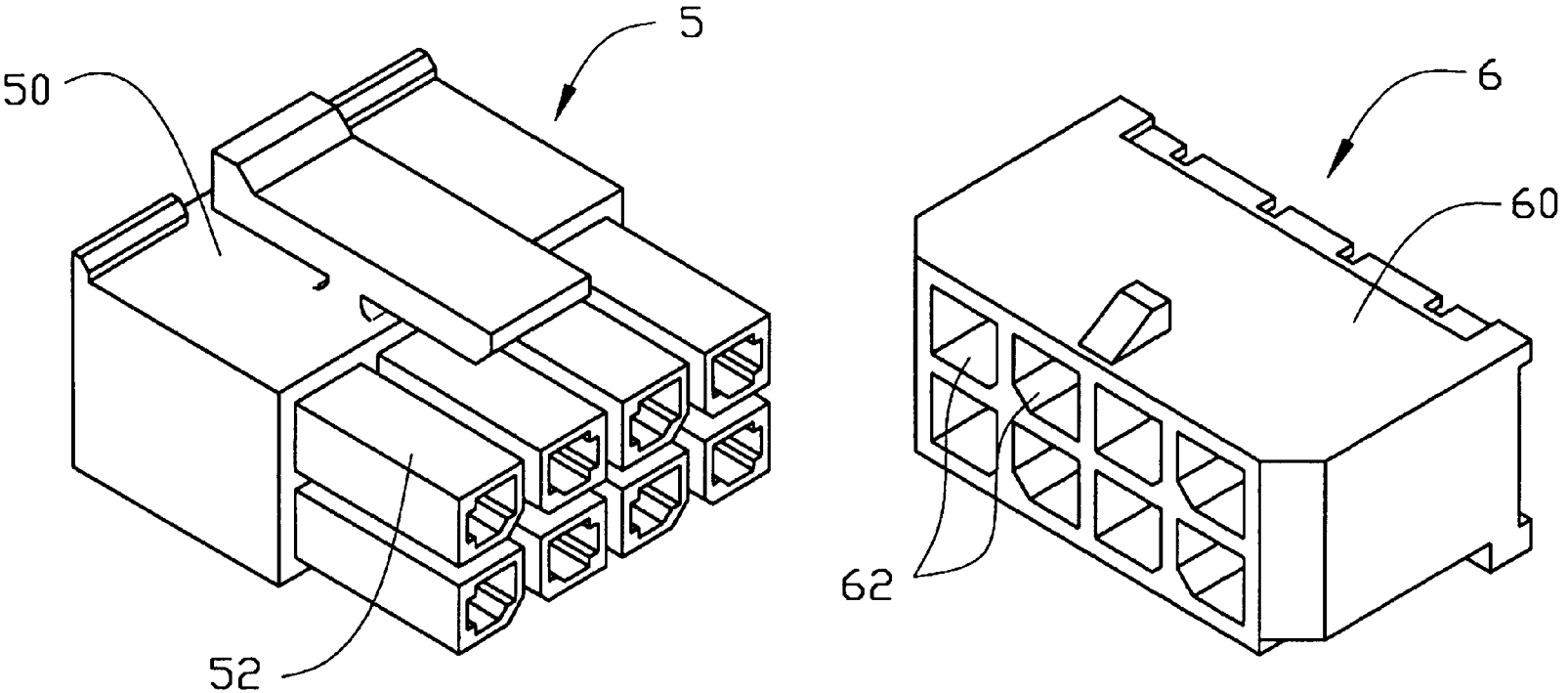
FIG. 1 (PRIOR ART)
FIG. 1 is a perspective view of conventional male and female electrical connectors.
Figure 2A:
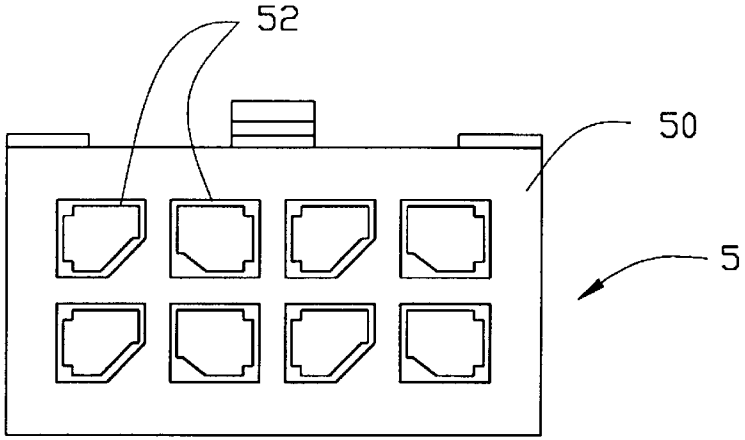
FIG. 2A (PRIOR ART)
FIG. 2A is a front view of the male connector of FIG. 1.
Figure 2B:
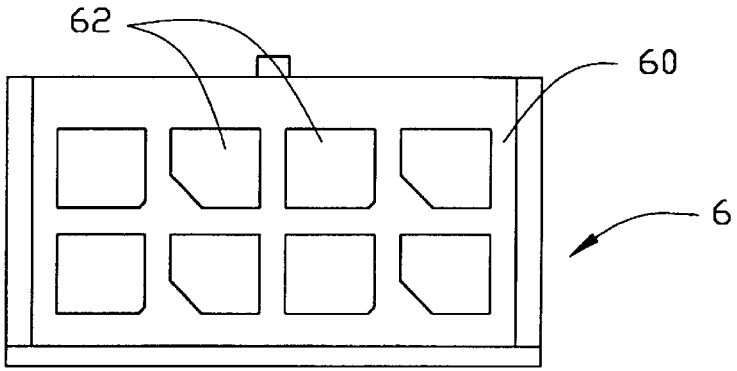
FIG. 2B (PRIOR ART)
FIG. 2B is a front view of the female connector of FIG. 1.

For facilitating understanding, like components are designated by like reference numerals through out the description of the various embodiments as shown in the attached drawing figures.

Figure 3:
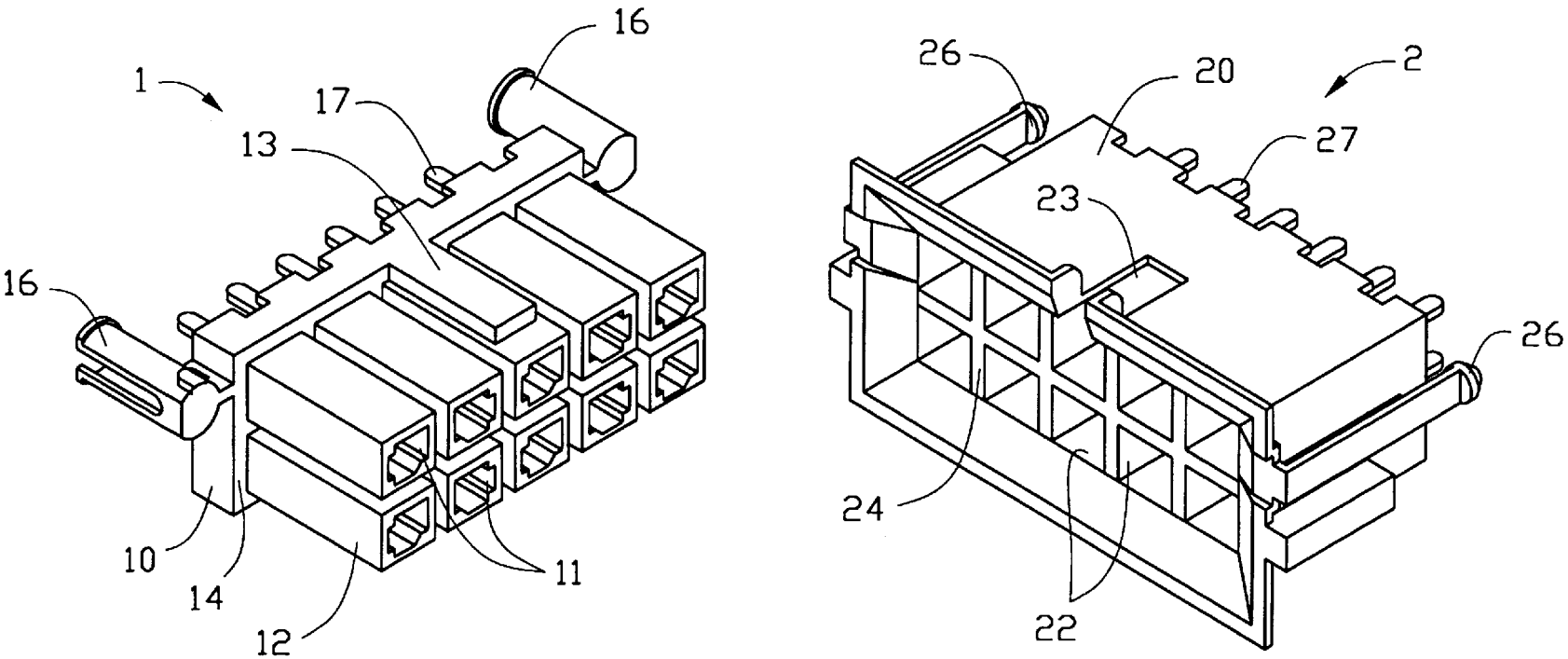
FIG. 3 is a perspective, unassembled view of the electrical connector in accordance with the present invention.
Figure 4:
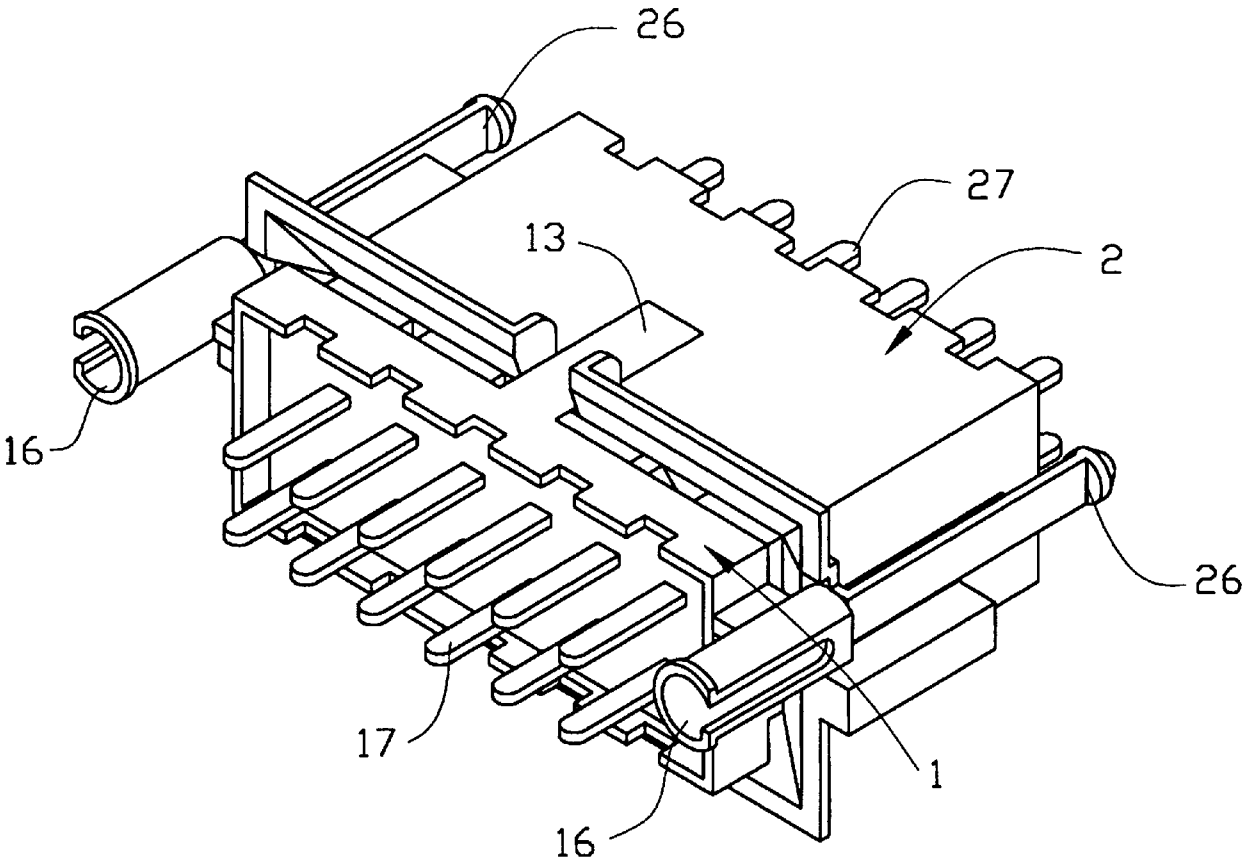
FIG. 4 is an assembled view of FIG. 3.

Referring to FIGS. 3 and 4, an electrical connector assembly comprises a male connector 1 and a female connector 2. The male connector 1 includes a housing 10, a plurality of silos 12 extending from a mating face 14 thereof and a plurality of contacts 17 received in corresponding passageways 11 defined in the silos 12. Each silo 12 has the same rectangular cross-section, therefore the corresponding mold for forming the silos 12 has a simple structure. A guiding arm 13 is formed on a top surface of the male connector 1, and a pair of fixing bars 16 extends from distal ends of the housing 10 for securing the male connector 1 to a circuit board (not shown).

The female connector 2 includes a housing 20, a plurality of receptacles 22, an engaging slot 23, a plurality of terminals 27 and a pair of locking poles 26. The receptacles 22 are formed in the housing 20 for engaging with the corresponding silos 12 of the male connector 1, and the terminals 27 are received in the receptacles 22 for electrically contacting the corresponding contacts 17 of the male connector 1. A mating face 24 of the housing 20 is formed proximate openings (not labeled) of the receptacles 22. The engaging slot 23 is formed in a top surface of the housing 20 for latching the connectors together. The engaging slot 23 prevents improper engagement between the connectors in assembly. The locking poles 26 extend from distal ends of the housing 20 for securing the female connector 2 to a circuit board (not shown). Each receptacle 22 has the same profile for engaging with the corresponding silo 12.

When properly assembled, the guiding arm 13 is inserted into the corresponding engaging slot 23, the silos 12 are guided into the corresponding receptacles 22, and the mating faces 14, 24 contact each other. If the connectors 1, 2 are improperly assembled, the guiding arm 13 can not be properly guided into the engaging slot 23 and the silos 12 can not engage with the corresponding receptacles 22. Thus, the guiding arm 13 and the engaging slot 23 prevent improper engagement between the connectors 1, 2. The silos 12 and the receptacles 22 are manufactured to have as the same profile thereby simplifying production and reducing production costs.

Figure 5:
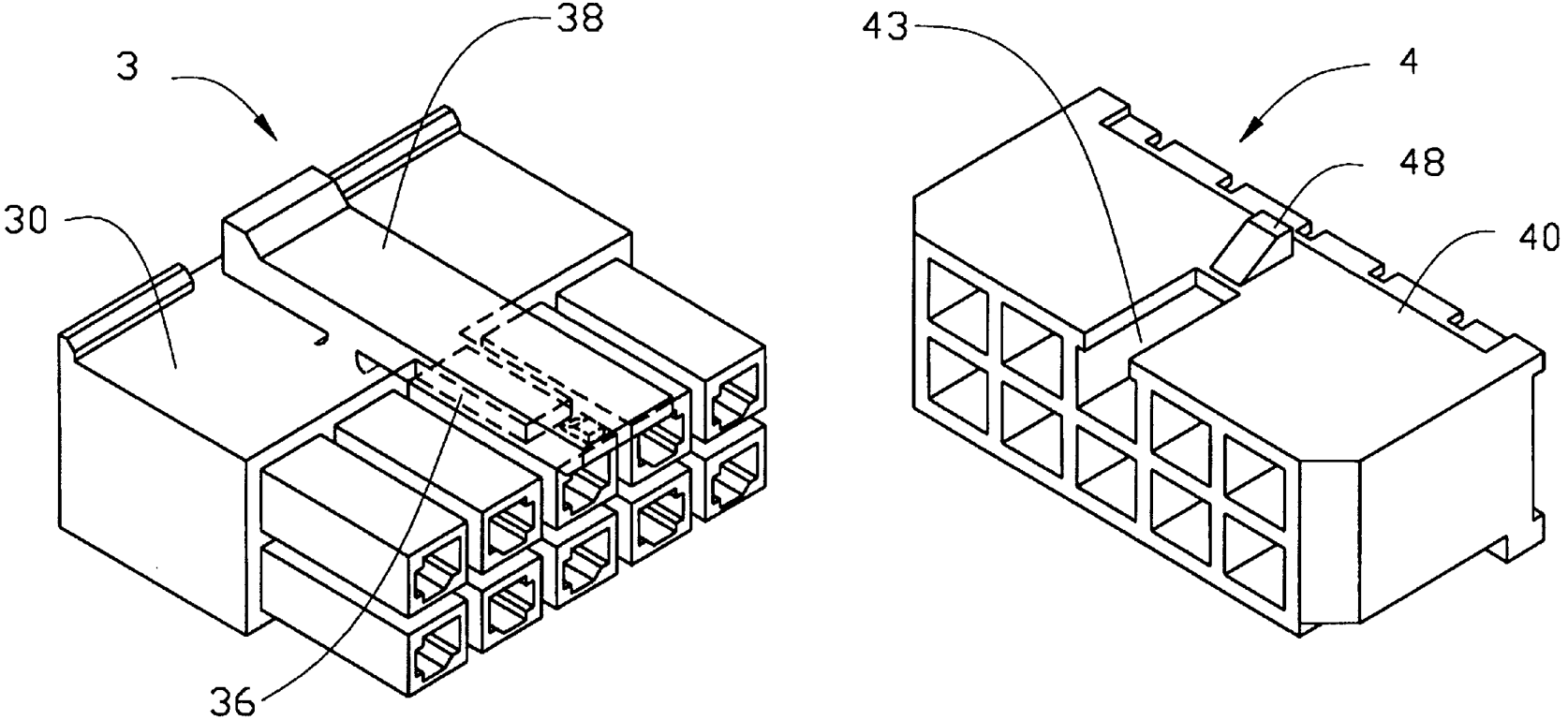
FIG. 5 is a perspective, unassembled view of another embodiment of the electrical connector in accordance with the present invention.
Figure 6:
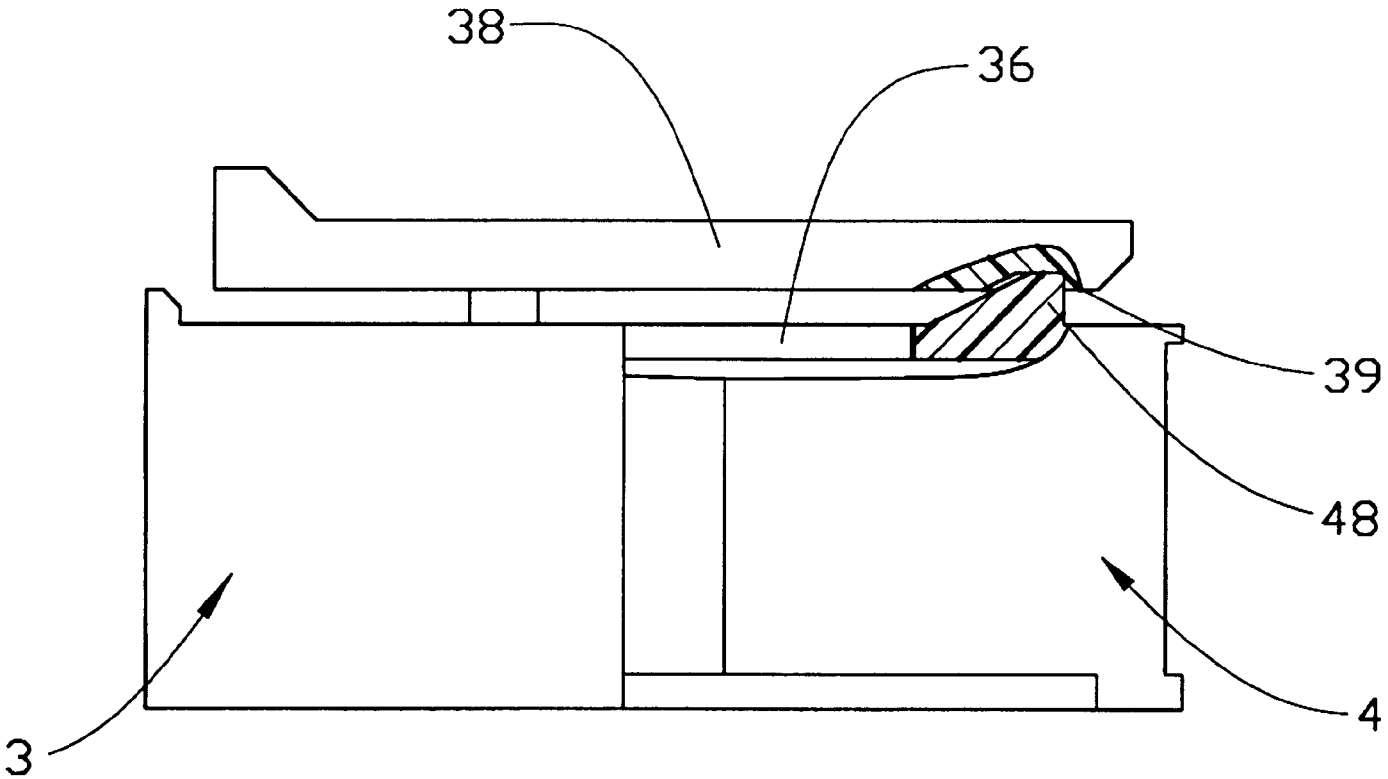
FIG. 6 is an assembled, partially cutaway, side view of FIG. 5.

Referring to FIGS. 5 and 6, another embodiment of the present invention comprises a male connector 3 and a female connector 4. The male connector 3 includes a housing 30, a latch arm 38 formed on the top surface of the housing 30 and a guiding arm 36 formed under the latch arm 38. A barb 39 is formed on a bottom surface of the free end of the resilient latch arm 38. The female connector 4 includes a housing 40, an engaging slot 43 and a chamfered latch boss 48. The chamfered latch boss 48 is formed on a top surface of the housing 40 corresponding to the latch arm 38. In assembly, the barb 39 of the latch arm 38 engages with the chamfered latch boss 48 for securely mating the connectors together. The engaging slot 43 guides the guiding arm 36 for preventing improper engagement.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. An electrical connector assembly comprising:

a male connector having an insulative body, a plurality of silos longitudinally projecting from the body, a plurality of contacts received in the silos, and a latch arm extending longitudinally from the body above the silos, and a latch arm formed under the guiding arm; and a female connector having an insulative housing, a plurality of receptacles formed in the housing for engaging with the corresponding silos, an engaging slot formed in the housing for engaging with the guiding arm, a chamfered latch boss formed proximate the engaging slot, and a plurality of terminals received in the receptacles for electrically contacting the corresponding contacts of the male connector;

wherein the engaging slot is formed in a top surface of the housing;

wherein the latch arm forms a barb on a bottom surface of the free end thereof for engaging with the corresponding chamfered latch boss of the female connector to ensure proper mating of the connectors.

* * * * *